US005513748A

United States Patent [19]

Focke et al.

[11] Patent Number: 5,513,748

[45] Date of Patent: May 7, 1996

[54] PACK, NAMELY HINGE-LID PACK

[75] Inventors: Heinz Focke, Verden; Henry Buse, Visselhövede, both of Germany

[73] Assignee: Focke & Co. (GmbH & Co.), Verden, Germany

[21] Appl. No.: 224,535

[22] Filed: Apr. 7, 1994

[30] Foreign Application Priority Data

Apr. 8, 1993 [DE] Germany ..... 43 11 563.2

[51] Int. Cl.[6] ..... B65D 85/10

[52] U.S. Cl. ..... 206/268; 206/256; 206/261; 206/273; 229/120.03; 229/120.32; 229/160.1

[58] Field of Search ..... 206/256, 261, 206/268, 273; 229/120.03, 120.82, 160.1

[56] References Cited

U.S. PATENT DOCUMENTS

| | | | |
|---|---|---|---|
| 2,213,525 | 9/1940 | Laflamme | 229/121 |
| 2,367,476 | 1/1945 | Tyrseck | 206/268 |
| 3,039,671 | 6/1962 | Chiamardas | 206/268 |
| 3,079,064 | 2/1963 | Ringler . | |
| 3,708,108 | 1/1973 | Rosenburg, Jr. | 206/268 |
| 4,200,221 | 4/1980 | Focke et al. | 229/160.1 |
| 4,294,353 | 10/1981 | Focke et al. | 206/273 |
| 4,779,737 | 10/1988 | Umehara et al. | 229/120.03 |
| 5,024,376 | 6/1991 | Focke | 229/160.1 |
| 5,074,412 | 12/1991 | White . | |
| 5,092,516 | 3/1992 | Kastanek | 229/226 |
| 5,161,733 | 10/1992 | Latif | 206/273 |

FOREIGN PATENT DOCUMENTS

| | | |
|---|---|---|
| 0380898 | 8/1990 | European Pat. Off. . |
| 1105340 | 11/1958 | Germany . |
| 1993459 | 9/1968 | Germany . |
| 2135776 | 2/1973 | Germany . |
| 2350023 | 4/1975 | Germany . |
| 2551427 | 5/1977 | Germany . |
| 2800393 | 7/1979 | Germany . |
| 8803726 | 8/1989 | Germany . |

*Primary Examiner*—Paul T. Sewell
*Attorney, Agent, or Firm*—Sughrue, Mion, Zinn, Macpeak & Seas

[57] ABSTRACT

Pack, namely hinge-lid pack, made from thin cardboard, for cigarettes or other smoker's articles. Hinge-lid packs are conventionally constructed in such a way that a lid (14, 15) is pivotably connected to a pack part (12, 13). To increase the receiving capacity, a double pack consisting of two individual hinge-lid packs (10, 11) is formed from a common one-piece blank. This is designed in such a way that the double pack is folded on the cross-winding principle and thereafter two end regions are each provided with a lid (14, 15). The lids (14, 15) are to be opened in opposite directions. Within the double pack, the individual hinge-lid packs (10, 11) are separated from one another approximately centrally by means of bottom walls (34, 35). The bottom walls (34, 35) are parts (bottom tabs 67) of the collar (36, 37).

15 Claims, 5 Drawing Sheets

PACK, NAMELY HINGE-LID PACK

BACKGROUND OF THE INVENTION

The invention relates to a pack, namely hinge-lid pack, made from thin cardboard, consisting of a pack part with a lid arranged on each of mutually opposite end regions of the latter and connected pivotably thereto, a double pack which consists of two individual hinge-lid packs being formed from a common blank.

Hinge-lid packs are known throughout the world as packaging for cigarettes. The hinge-lid packs conventionally consist of a pack part and of a lid connected to a rear wall of the latter. Within the pack part, there is arranged, in the region of the front wall and side walls, a collar of which a portion projects out of the pack part. The invention is concerned with a further development of packs of this type, namely with double packs having two hinge-lid packs.

SUMMARY OF THE INVENTION

The object on which the invention is based is to design the pack mentioned in the preamble, in such a way that the simplest possible production is possible.

To achieve this object, the pack according to the invention is defined in that, within the double pack, at least one bottom wall between the individual hinge-lid packs is formed from a separate blank.

In this double pack, a capacity for receiving two hinge-lid packs is provided. These consist of a common one-piece blank. The double pack is especially suitable for shorter elongate articles, particularly for shorter cigarettes or cigarette-like smoker's articles. The bottom wall provided according to the invention and consisting of a separate blank allows a simple handling of the double pack during production. The blank for the bottom wall can be assembled together with the blank for the double pack at the best possible moment.

According to a further feature of the invention, the bottom wall is designed as part of at least one collar within one of the individual hinge-lid packs. A pack according to the invention, in which each individual hinge-lid pack has a collar, which, by virtue of appropriate dimensioning and design, forms the bottom wall of the individual hinge-lid pack, is especially advantageous. The double pack according to the invention consequently has a double-layer bottom wall.

The double pack according to the invention consists of a one-piece blank which is constructed on the cross-winding principle. Accordingly, blank regions for forming the front wall, rear wall, lid front wall and lid rear wall are arranged next to one another, side walls and lid side walls being formed between corresponding main walls of the blank or of the pack. An overlap of the blank in the region of an edge strip takes place in the region of one of the two side walls or lid side walls. The blank thus designed is provided with punching cuts for delimiting the lid from the pack part. The punching cuts are connected to the blank by means of severable residual connections.

Further particulars of the invention are explained in more detail below by means of exemplary embodiments. In the drawing:

DESCRIPTION OF PREFERRED EMBODIMENTS

Figure 1:
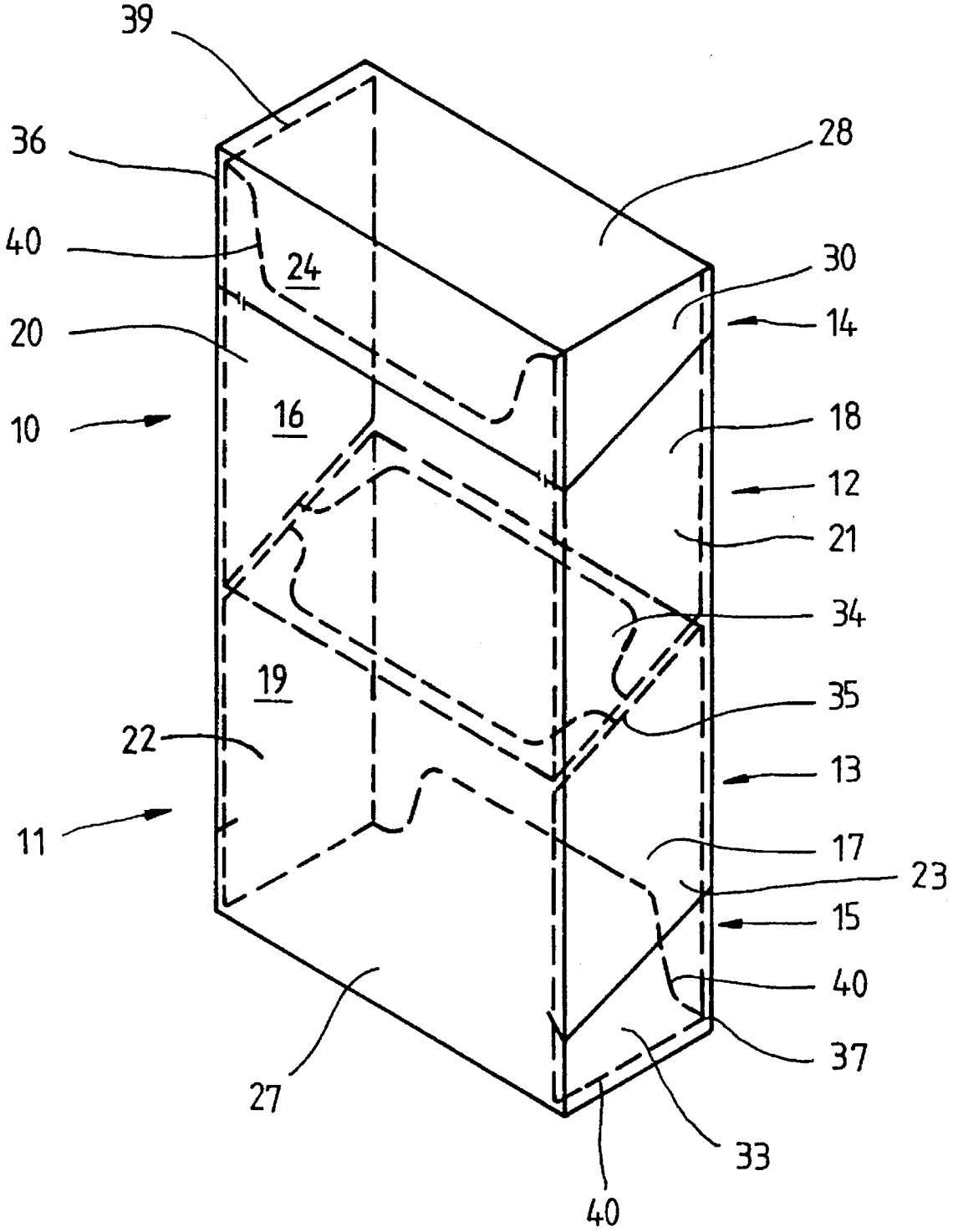
FIG. 1 shows an exemplary embodiment of a pack (double pack) according to the invention in a perspective representation.

The below-described hinge-lid packs serve preferably for receiving (shorter) cigarettes or other similar stick-shaped smoker's articles. The hinge-lid pack is designed as a double pack, namely with two individual hinge-lid packs 10 and 11. Each of these part packs is designed as a hinge-lid pack, namely with a pack part 12 and 13 and with a lid 14 and 15. In a position of the pack according to FIG. 1, an upper individual hinge-lid pack 10 and a lower individual hinge-lid pack 11 are obtained. In this position, therefore, the lids 14 and 15 assigned to the two individual hinge-lid packs 10, 11 are likewise formed at the top and bottom. A further special feature is that the lids 14 and 15 are laterally reversed or are offset at 180° relative to one another.

Each pack part 12, 13 consists of a front wall 16 and 17, of a rear wall 18 and 19 and of side walls 20, 21 and 22, 23.

The lid 14 is designed correspondingly, namely consists, in each case, of a lid front wall 24, 25, of a lid rear wall 26, 27, of a lid top wall 28, 29 and of lid side walls 30, 31 and 32, 33.

The two individual hinge-lid packs 10, 11 are separated from one another on the inside by a transversely directed bottom wall. In the present example, each individual hinge-lid pack 10, 11 is assigned its own bottom wall 34, 35. In this exemplary embodiment, therefore, the double pack is subdivided into the two individual hinge-lid packs by an approximately central double-layer partition wall.

Furthermore, a collar 36, 37 consisting of an independent blank (FIG. 6) is arranged in each individual hinge-lid pack 10, 11. This collar consists of a collar front wall 38 and collar side tabs 39, 40. The collar 36, 37 extends, in each case, in the region of the front walls 16, 17 and of the side walls 20 to 23.

The entire double pack, with the exception of the blanks for the collars 36, 37, consists of a one-piece common blank. According to the exemplary embodiments of FIG. 4 and FIG. 5, this is constructed on the cross-winding principle.

In the first-mentioned exemplary embodiment, the blank consists of two main walls 41, 42. These are dimensioned in such a way that they each jointly form a lid front wall 24 and 25, a front wall 16 and 17, a rear wall 18 and 19 and a lid rear wall 26 and 27. The main walls thus form the entire front or rear side of a double pack.

Located within the blank between the main walls 41, 42 thus dimensioned is a side-wall strip 43. This too extends over the entire height of the double pack, and therefore forms, in each case, one of the side walls 22, 23 of the individual hinge-lid packs 10, 11 and one of the lid side walls 32, 33.

Attached to the free side of one main wall 41 is a second side-wall strip 44. This likewise extends over the entire height of the double pack, to form side walls 20, 21 and lid side walls 30, 31.

Figure 3:
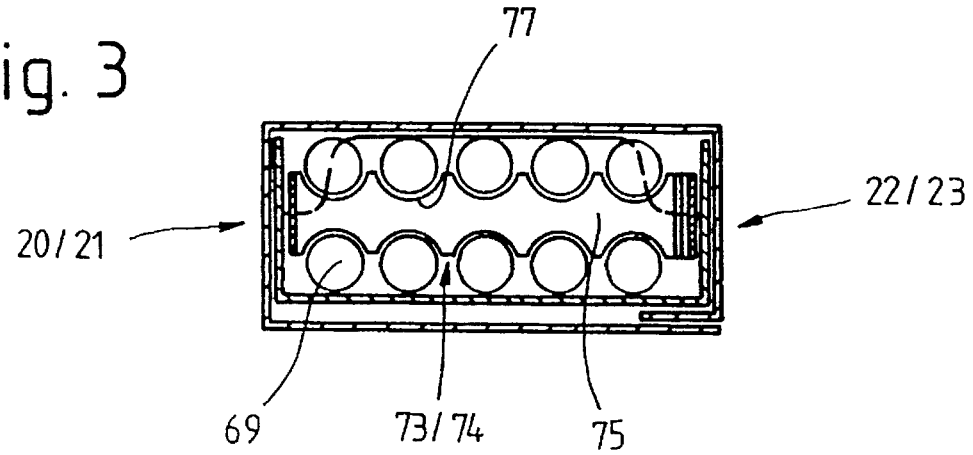
FIG. 3 shows the pack according to FIGS. 1 and 2 in horizontal section.

To form a pack of closed (cuboid) cross-section, an edge strip 45 is attached to the free side of the side-wall strip 44 and becomes or is connected (FIG. 3) to an edge region of the inside of the main wall 42, specifically by adhesive bonding. The edge strip 45 extends over the entire height of the double pack and therefore over the entire length of the main walls 41, 42.

To form the lid top walls 28, 29 (which also form the two opposite ends of the double-pack (10, 11)), folding tabs are arranged on the free narrow sides of the main walls 41, 42 and of the side-wall strips 43, 44. These folding tabs are an inner lid tab 46 and an outer lid tab 47. These are folded one on top of the other over their entire area. Corner tabs 48, 49 are formed in the region of the side-wall strips 43, 44. These corner tabs are likewise folded into the plane of the lid top wall 28, 29, specifically on the inside, that is to say directly facing the pack content.

Figure 2:
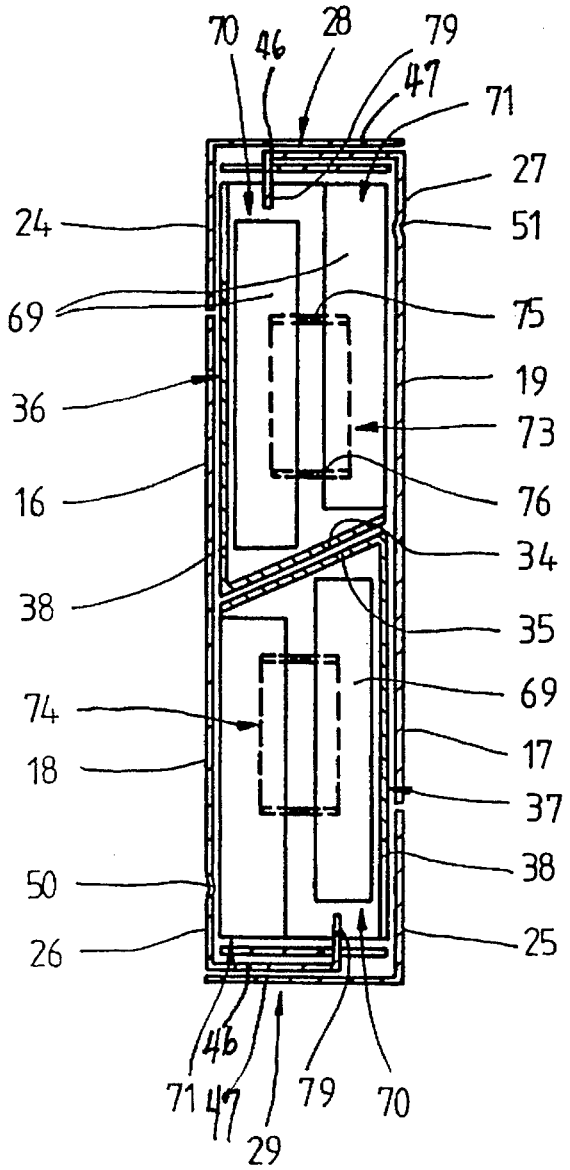
FIG. 2 shows the pack according to FIG. 1 in vertical section.

In the region of the main walls 41, 42 and of the side-wall strips 43, 44, the described parts or walls of the individual hinge-lid packs 10, 11 are separated from one another by means of folding lines or punching cuts. The lid rear walls 26 and 27 formed on mutually opposite end regions of the main walls 41, 42 are delimited relative to the rear walls 18 and 19 by means of a folding line which at the same time act as a hinge line 50, 51 of the individual hinge-lid packs 10, 11 (see also FIG. 2). The lid front walls 24 and 25 likewise formed in the region of the main wall 41, 42 are respectively divided off from the adjacent front wall 16, 17 by means of a transversely directed punching cut 52, 53. The punching cuts 52, 53 extend over the entire width of the main walls 41, 42, but are provided with residual connections 54 or residual webs, specifically, in the example shown, with two residual connections 54 arranged at a distance from one another. These ensure the sufficient cohesion of the blank in the region of the main walls 41, 42, especially also during the production or folding of the pack. When the latter is used, namely when the lid 14 or 15 is opened for the first time, the residual connections 54 are severed, so that the lid front wall 24, 25 is freed from the adjoining front wall 16, 17.

The punching cut 52, 53 of the main wall 41 or 42 has a continuation in the region of the adjacent side-wall strips 43, 44. In the region of the main wall 41, oblique cuts 55, 56 adjoin the two ends of the punching cut 52. These oblique cuts 55, 56 extend at an angle to the punching cut 52 in the region of the side-wall strips 43 and 44. The oblique cuts 55, 56 define an obliquely directed closing or butting edge, conventional in hinge-lid packs, in the region of side walls 20 to 23 of a hinge-lid pack, namely as a delimitation between the pack part 12, 13 and the lid 14, 15 (see also FIG. 1).

Similarly, an oblique cut 57 is provided adjoining the punching cut 53 in the region of the side-wall strip 43, specifically on a side located opposite the oblique cut 56. To complete the delimitation between the lid 14 and pack part 12, a further oblique cut 58 is made in the region of the side-wall strip 44. In the ready-folded pack, this further oblique cut 58 takes effect as an addition or continuation of the punching cut 53 on the side located opposite the oblique cut 57. For this purpose, there is also made in the region of the edge strip 45 an additional cut 59 which adjoins the oblique cut 58 and which coincides with an edge portion of the punching cut 53 in the ready-folded pack. For the reasons described, a residual connection 60 is likewise provided in the region of the additional cut 59.

A double pack in the design according to FIG. 1 is formed from a blank of this type by tubular folding, the tube having a rectangular cross-section. After the connection of the edge strip 45 to the main wall 42, the lower and upper folding tabs 46 to 49 are folded. The pack produced thus far can then be opened on two opposite sides as a result of a pivoting of the lids 14, 15, these being pivotable in opposite directions.

Figure 4:
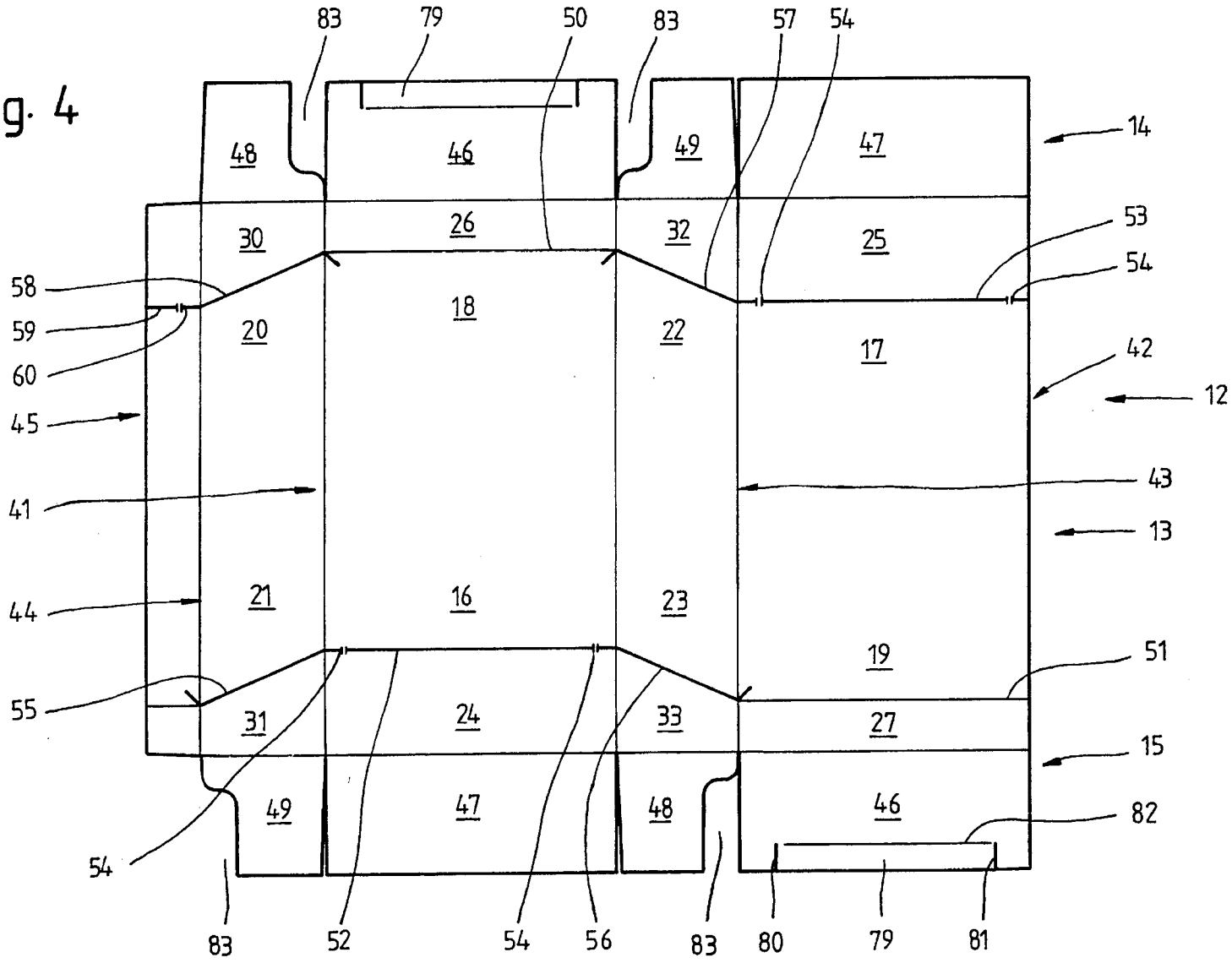
FIG. 4 shows a spread-out blank for a pack according to FIGS. 1 to 3.
Figure 5:
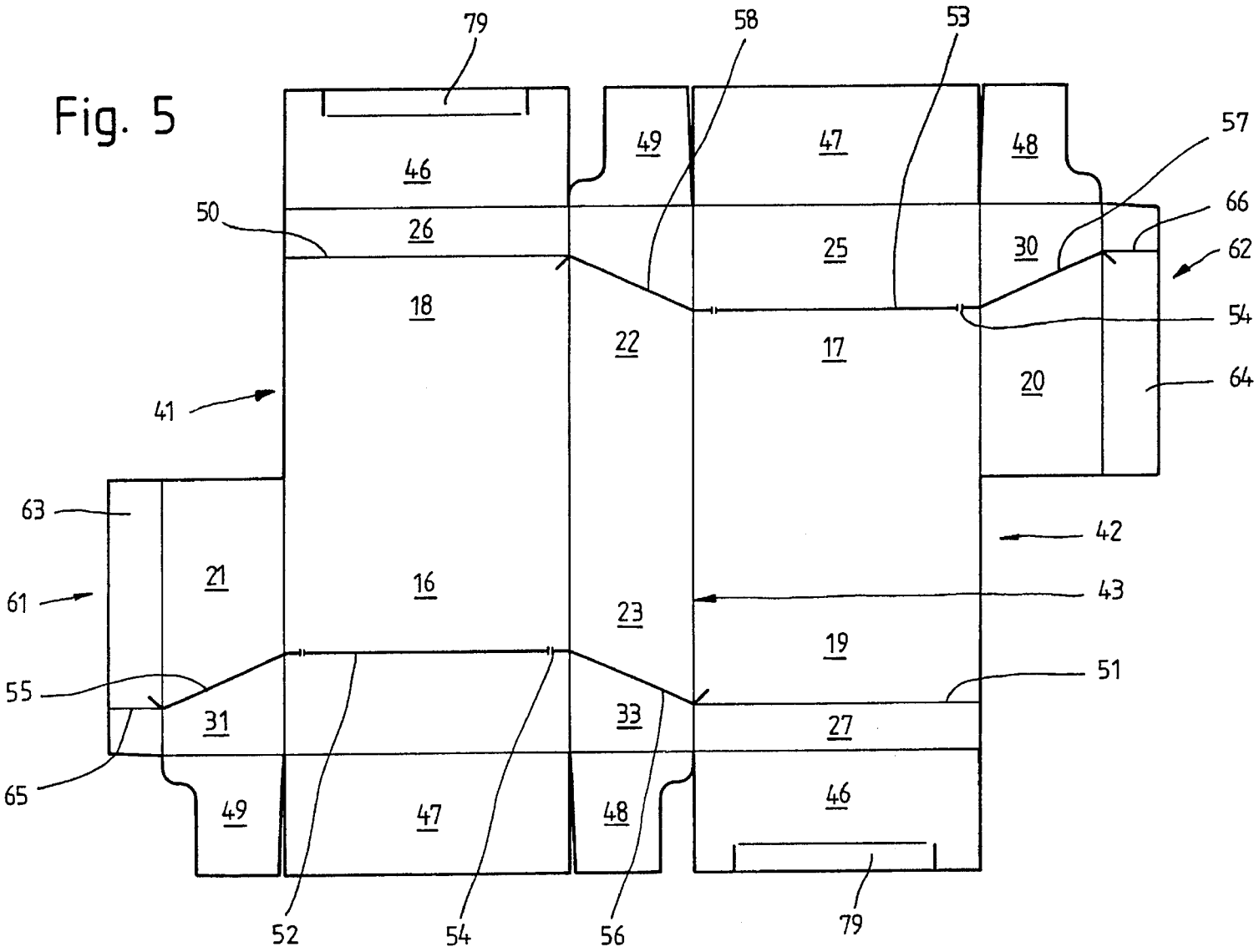
FIG. 5 shows a blank in a corresponding representation for another exemplary embodiment of a pack.

The blank according to FIG. 5 is of similar construction and leads to a pack, namely double pack, outwardly of virtually identical design. The difference is that, in this exemplary embodiment, the side-wall strip 44 located at the edge is divided and is assigned to the respective pack side or blank side. Part strips 61, 62, which each have half the dimension of the side-wall strip 44 according to FIG. 4, are accordingly attached to the otherwise free sides of the main walls 41, 42. As a result, the punching cuts 52, 53 described, together with the adjacent oblique cuts 55 and 56 or 57 and 58, can be made continuously and adjoiningly, so that continuous trapezoidal punching cuts are obtained in the regions of the blank which are located diametrically opposite one another.

The blank is processed to form the double pack in virtually the same way as in the exemplary embodiment of FIG. 4. Thus, the part strips 61, 62 are connected to otherwise free edge regions of the main walls 41 on the one hand and 42 on the other hand, specifically via corresponding edge strips 63, 64. However, in the region of these, there is no punching cut, but only a hinge addition 65, 66. This is a folding or embossing line which, in the finished pack, covers a part region, located at the edge, of the hinge line 50 and 51. In the finished pack (double pack), in this example there appears, in the region of one longitudinal side, a division between the two pack parts 12, 13, namely a transversely directed joint as a butting point between the part strips 61, 62. The side walls 20 and 21 of the individual hinge-lid packs 10, 11 are thereby separated from one another by means of this butt joint.

Figure 6:
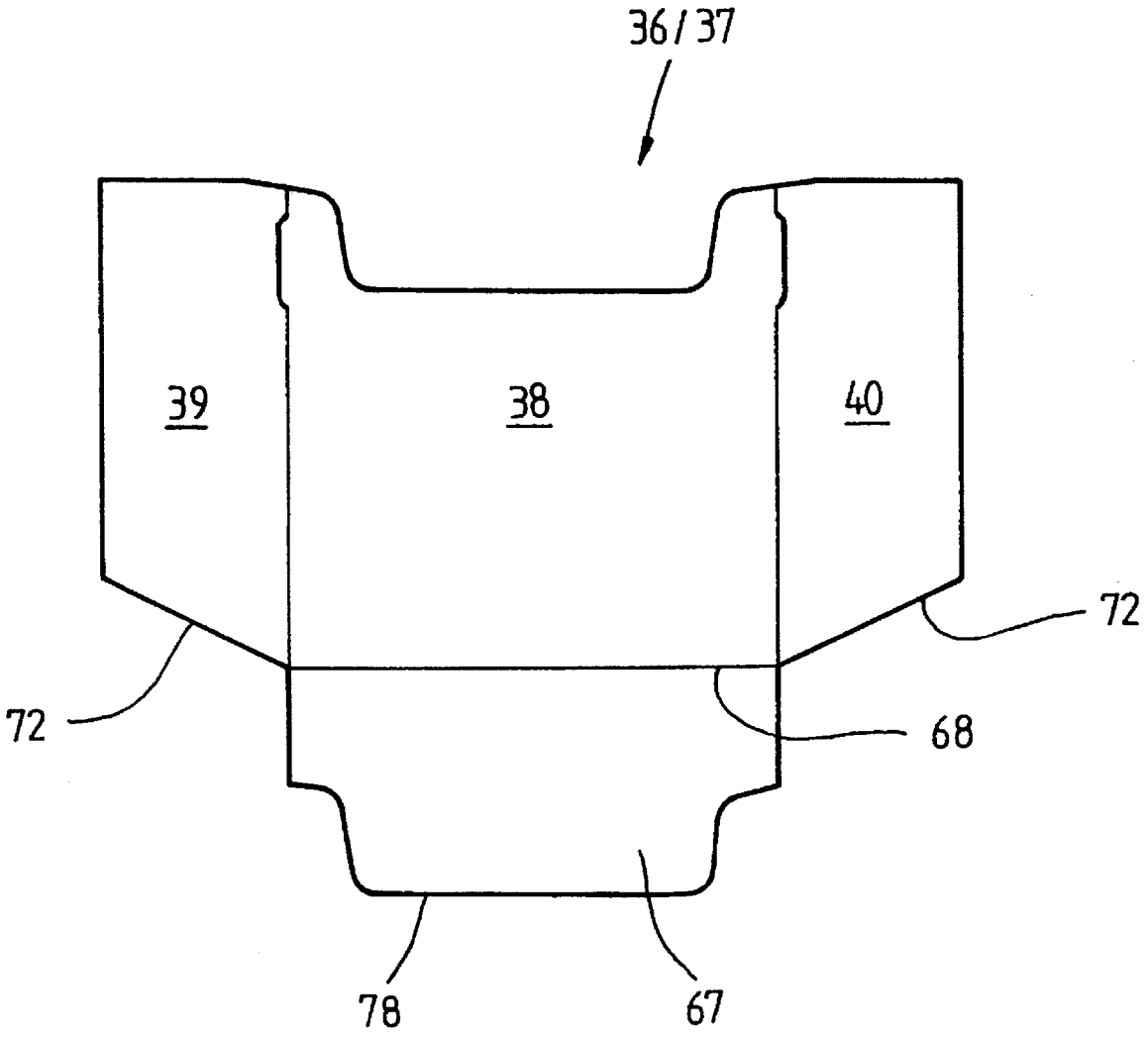
FIG. 6 shows a blank for a collar of the pack, likewise in a spread-out position.

A further particular feature of the pack is the formation of the bottom walls 34, 35. In the present case, these consist of part of the one-piece blank for the collar 36, 37 (FIG. 6). A bottom tab 67 is attached to the collar front wall 38 as a continuation of the collar front wall 38. This bottom tab 67 is folded about a folding line 68 into a transverse position in order to form a bottom wall 34, 35. The collar 36, 37 or the collar front wall 38 is, at the same time, dimensioned in such a way that it extends as far as the bottom wall 34, 35 of a pack part 12, 13, that is to say over the entire height of the front wall 16, 17. The folding line 68 at the same time forms an inner edge in the pack part 12, 13.

In the exemplary embodiment illustrated (FIG. 1), the bottom wall 34, 35 is directed obliquely relative to the front wall 16, 17 and rear wall 18, 19. Each individual hinge-lid pack 10, 11 thus acquires an oblique bottom wall 34, 35, specifically such that the bottom wall 34, 35 is, in each case, lower in the region of the front wall 16, 17 than in the region of the rear wall 18, 19.

To form a stable bottom wall 34, 35 directed obliquely, the bottom tab 67 of the collar 36, 37 is dimensioned in such a way that a stable oblique position is obtained automatically. The width of the bottom tab 67, that is to say the distance between the folding line 68 and a free supporting edge 78, is greater than the corresponding clear inner dimension of the individual hinge-lid packs 10, 11. As a result, the supporting edge 78 can be supported on the opposite wall, namely on the rear wall 18, 19, to form a stable oblique position. The supporting edge 78 has a contour which corresponds to the conventional upper contour of the collar front wall 38. The blanks can therefore to that extent be produced free of waste from a continuous material web.

As a result of the oblique position of the bottom wall 34, 35, a special positioning of the pack content in the individual hinge-lid packs 10, 11 is possible. The example shown relates to (short) cigarettes 69 which are arranged in two rows 70, 71 in each individual hinge-lid pack 10, 11, specifically at a distance from one another in each case. The rows 70, 71, by being supported on the oblique bottom wall 34, 35, assume a stepped position. The row 71 facing the rear wall 18, 19 projects upwards beyond the front row 70.

The collar side tabs 39, 40 likewise extend as far as the bottom wall 34, 35. To adapt to the oblique position of the latter, the collar side tabs 39, 40 are provided with a matching lower oblique edge 72.

In the exemplary embodiment illustrated, to position the cigarettes 69 in two rows 70, 71 and to form clearances between the cigarettes 69, a supporting member 73, 74 is arranged within each individual hinge-lid pack 10, 11. This supporting member 73, 74 is, in each case, arranged between the rows 70, 71 and at a distance from the lid 14, 15 and bottom wall 34, 35. Transversely directed supporting walls 75, 76 are provided with trough-like recesses 77. The cigarettes 69 rest positively in these. The cigarettes 69 are thereby fixed in respect of lateral movements. The supporting member 73, 74 is expediently connected to the side walls 20 to 23 and to the collar side tabs 39, 40 as an inner delimitation of the individual hinge-lid pack 10, 11. The connection can be made by adhesive bonding.

In order to stabilize the stepped position of the rows 70, 71, especially while the double pack is being used, each individual hinge-lid pack 10, 11 is provided with a stop or holding-down device 79 for the lower, that is to say front row 70. The holding-down device 79 is designed, here, as part of the lid 14, 15, specifically as an edge strip of the inner lid tab 46, to form the lid top wall 28, 29. This edge strip has a shorter longitudinal dimension than the inner lid tab 46. The edge strip is delimited by lateral incisions 80, 81 in the inner lid tab 46 and is folded about a folding line 82 into a position transverse to the inner lid tab 46 in order to form the holding-down device 79. The holding-down device 79 thereby extends approximately centrally above the row 70.

The inner corner tabs 48, 49, namely those facing the pack content, are provided, on the side facing the inner lid tab 46, with a recess 83 formed by punching, that is to say are designed narrower in this region than the width of the side walls 20 to 23. In the ready-folded pack (FIG. 2), the holding-down device 79 passes through the strip-shaped gap thus produced.

We claim:

1. A hinge-lid pack assembly made from thin cardboard, comprising:

a) a double pack comprising two individual hinge-lid packs (10, 11) formed from a common blank; and wherein:

b) the double pack consists of two pack parts (12, 13) having mutually opposite narrow walls (20 to 23), long walls (16 to 19) and end walls;

c) respective lids (14, 15), having top walls (28, 29), are pivotably connected to the pack parts at said opposite long walls of said double pack, said end walls being formed by said lid top walls (28, 29);

d) inside of said pack part, a bottom wall (34, 35) is formed from a separate blank between the individual hinge-lid packs (10, 11); and e) said bottom wall (34, 35) is obliquely positioned at an acute angle with respect to said long walls and said lid top walls.

2. The hinge-lid pack assembly as claimed in claim 1, wherein said lids (14, 15) are individually hinged to respective opposite long walls, and wherein each lid has lid side walls (30 to 33) having lower edges which extend parallel to the bottom wall (34, 35) when the lid is closed.

3. The pack assembly as claimed in claim 1, wherein mutually opposite lid top walls (28, 29) of the two individual hinge-lid packs (10, 11) are formed, in each case, from folding inner lid tabs (46), outer lid tabs (47) and corner tabs (48 and 49) which adjoin free narrow sides of the side-wall strips (43, 44).

4. The hinge-lid pack assembly as claimed in claim 1, wherein the bottom wall (34, 35) is formed as a part of at least one collar (36, 37) inside of an individual hinge-lid pack (10, 11).

5. The hinge-lid pack assembly as claimed in claim 4, wherein said bottom wall (34, 35) is a bottom tab (67) of a collar from wall (38), said bottom tab (67) being folded into an acute position relative to the collar front wall (38) to form the bottom wall (34, 35).

6. The pack assembly as claimed in claim 5, wherein the bottom tab (67) has a larger width than an inner width of the individual hinge-lid packs (10, 11), in such a way that, in the oblique position, an otherwise free edge of the bottom tab (67) is supported on a pack rear wall (18, 19) located opposite the collar front wall (38).

7. The hinge-lid pack assembly as claimed in claim 4, wherein there are two collars (36, 37) forming two corresponding bottom walls (34, 35) wherein one collar is arranged in each individual hinge-lid pack (10, 11), wherein the two collars have corresponding collar front walls (38) in a region of diagonally opposite ones of said long walls (16 to 19), and wherein the corresponding bottom walls (34, 35) adjoin one another and at least partially overlap overlapping one another.

8. The pack as claimed in claim 1, wherein the double pack consists of a one-piece blank, in which, in each case, two main walls (41, 42) successively form a lid front wall (24 and 25), a front wall (16 and 17) of a pack part (12, 13), a rear wall (18, 19) and a lid rear wall (26, 27), the front wall (16 and 17) and the lid front wall (24, 25) being separated from one another, in each case, by means of cuts (52, 53), with severable residual connections (54).

9. The pack assembly as claimed in claim 8, wherein the one-piece blank for forming the double pack is constructed on the cross-winding principle, a side-wall strip (43) being arranged between the main walls (41, 42) in order to form side walls (22, 23) of the two individual hinge-lid packs (10, 11) and to form lid side walls (32, 33), the regions of the side walls (22, 23) being separated from the lid side walls (32, 33) by oblique cuts (56, 57) adjoining the cuts (52, 53) of the main walls (41, 42).

10. The pack assembly as claimed in claim 9, wherein a continuous side-wall strip (44) for forming further opposite side walls (20, 21) and for forming lid side walls (30, 31) is arranged on an otherwise free edge of a main wall (41), the regions of the side walls (20, 21) and of the lid side walls (30, 31) being separated from one another by means of obliquely extending cuts, (55 and 58).

11. The pack assembly as claimed in claim 10, wherein an edge strip (45) is arranged on a free edge of the side-wall strip (44), for connection to a main wall (42) adjacent when the double pack is folded, the edge strip (45) having an additional cut (59) which adjoins the oblique cut (58) of the side-wall strip (44) and coincides with the cut (53) of the main wall (42) in the folded double pack, the free edge being an edge of the side-wall strip (44) located opposite the main wall (41).

12. The pack assembly as claimed in claim 9, wherein part strips (61, 62) are arranged on free lateral edges of the main walls (41, 42) in regions located diametrically opposite one another, in order to form side walls (20, 1) of the pack parts (12, 13) and lid side walls (30, 1) of the lids (14, 15), in each case oblique cuts (55, 58) which adjoin the punching cuts (52, 53) of the main walls (41, 42) being made in the region of the part strips (61, 62).

13. The pack assembly as claimed in claim 12, wherein an edge strip (63, 64) is attached to each part strip (61, 62) on a free edge, for connection to an edge region of a main wall (41, 42) which, in each case, is adjacent in the double pack when the double pack is folded.

14. The pack assembly as claimed in claim 8, wherein, to fix cigarettes (69) of a row (70) facing the front wall (16, 17), there is arranged, in the lid (14, 15) of the hinge-lid pack or individual hinge-lid pack (10, 11), a stop or holding-down device (79) which, in the closing position of the hinge-lid pack, acts from above on the cigarettes (69) or on the row (70).

15. The pack assembly as claimed in claim 14, wherein the holding-down device (79) is attached to a free edge of the inner lid tab (46) facing the lid front wall (24, 25), as a downwardly angled leg which extends over a part length of the inner lid tab (46), the corner tabs (48, 49) which face the pack content having a recess (83) for the passage of a portion of the holding-down device (79).

* * * * *